United States Patent [19]

Hedgecock et al.

[11] 3,990,509

[45] Nov. 9, 1976

[54] TOOL FOR SERVICING WELLS

[76] Inventors: Floyd R. Hedgecock, 501 Madison St.; Charles L. Van Atta, 507 Joaquin, both of Coalinga, Calif. 93210

[22] Filed: June 2, 1975

[21] Appl. No.: 582,597

[52] U.S. Cl. ..... 166/106; 417/434

[51] Int. Cl.[2] ..... E21B 43/00

[58] Field of Search ..... 166/106, 112; 417/236, 417/238, 239, 315, 455, 434, 443, 446

[56] References Cited

UNITED STATES PATENTS

| | | | |
|---|---|---|---|
| 3,158,200 | 11/1964 | Malone | 166/106 |
| 3,282,340 | 11/1966 | Park | 166/106 |
| 3,414,057 | 12/1968 | Harbison | 417/434 |
| 3,561,534 | 2/1971 | Dendy | 166/106 |

*Primary Examiner*—James A. Leppink
*Attorney, Agent, or Firm*—Huebner & Worrel

[57] ABSTRACT

A tool for use in wells having a first assembly with an internal fluid passage and a port interconnecting the exterior of the first assembly and the passage; a mechanism borne by the first assembly for releasably securing the first assembly in a well in a selected position; a housing enclosing a fluid chamber mounted on the first assembly; a second assembly having an end portion received in the fluid chamber for reciprocal movement in pumping relation to and from the first assembly and an opposite end portion adapted for connection to a pipe string in depending relation; and a valve mechanism selectively operable, upon movement of the end portion of the second assembly to the first assembly, to allow fluid movement from the second assembly into the fluid passage of the first assembly and, upon reciprocal movement of the end portion within the fluid chamber, to pump fluid through the port and first assembly into the second assembly and pipe string.

15 Claims, 11 Drawing Figures

TOOL FOR SERVICING WELLS

BACKGROUND OF THE INVENTION

1. Field Of The Invention

The present invention relates to a tool for servicing wells and more particularly to such a tool which is adaptable for use in wells of a variety of types to permit the injection of such fluids as acid, water, oil, cleansing agents and the like into a well and the formation laterally of the well for the purpose of maintaining the well by dissolving materials which clog and interfere with well operation as well as to clean, service and generally maintain all portions of a well casing and formation beyond the casing and to such a tool which can also be operated without removal from the well to extract such fluids from the well after use. While the present invention arose in connection with the servicing of wells and is conveniently described in connection with such use, it is to be understood that it may advantageously be employed in many other operational environments; such as boreholes, conduits, pipe lines, and the like and the term "wells" is intended to encompass such locations of use.

2. Description Of The Prior Art

In wells of all types, such as for oil, gas, water and the like, there is a propensity for minerals borne by the substance being recovered to become deposited on rock structures within the formation adjacent to the well, on the well casing and with apertures in the well casing through which such substances pass. Thus, over the period of use of the well it is necessary to utilize treating agents of a variety of types including acids, solvents, water and the like to treat the well casing, and the formation beyond the well casing for the removal of such deposited minerals so as to enhance the productivity of the well for continued use.

It has therefore been necessary to use several types of tools to inject such fluids into a well and to extract the fluids after use. In all of the conventional tools of which the applicant is aware, it is necessary to lower an appropriate tool into the well on the end of a pipe string composed of a multiplicity of endwardly interconnected pipe sections. Not infrequently, hundreds or even thousands of such pipe sections must be interconnected to reach the depths required. This, of course, requires that the pipe sections be interconnected as the tool is lowered into the well. Similarly, removal of the tool from the well requires the pipe sections to be disconnected as the tool is raised from the well. Such operations can require many days to complete. Furthermore, where the injected fluid is to be withdrawn from the well, as is normally the case, this process must be repeated at least a second time to permit the insertion of a second tool into the well for this purpose. In some instances, it is necessary or desirable to inject and extract several types of fluids sequentially into the well to accomplish the designed purpose. It will be seen that this necessitates the repetition of the interconnection and disconnection of the pipe sections for each type of fluid. The resultant expense, both as a function of man hours involved as well as of the "down time" during which the well is unproductive, places an extreme burden on the operation. The process can, in fact, prove to be prohibitively expensive where the effect of such maintenance is limited in duration.

Therefore, it has long been recognized that it would be desirable to have a tool for servicing wells useful in injecting fluids into and extracting fluids from a well which can simply be operated in sequence to inject into and extract from a well any number of fluids without removal of the tool from the well until the entire operation is completed and which is adaptable for use in wells of a variety of types, diameters, and depths.

SUMMARY OF THE INVENTION

It is therefore an object of the present invention to provide an improved tool for servicing wells.

Another object is to provide such a tool which is operable to inject fluid into and extract fluid from a well and to repeat this process for each of a plurality of fluids without removal of the tool from the well during the entire operation.

Another object is to provide such a tool which is adaptable for use in wells of a wide variety of types, diameters, and depths.

Another object is to provide such a tool which possesses a flexibility of operation providing the operators with the ability to inject fluid into and extract fluid from any portion of a borehole in the volume desired and over a period of time most appropriate to the particular fluid employed and which permits the operators to sample the effectiveness of the operation prior to the removal of the tool from the borehole thereby permitting further treatment if the sampled results are less than satisfactory.

Another object is to provide such a tool which can, in a first configuration, be operated to deliver a selected fluid received from a pipe string on which the tool is mounted to a selected point in a well and to the formation beyond the well and which, in a second configuration, can be operated as a pump to extract fluid from the well and surrounding formation and to pump the extracted fluid to the earth's surface.

Another object is to provide such a tool which can be modified for use in well casings of different diameters by replacing a minimum number of parts thereon.

Another object is to provide such a tool which utilizes component parts which are readily available in the industry.

Another object is to provide such a tool which possesses a simplicity of construction and a dependability of operation which insure that the tool can be employed without specialized training and which further insure a long operational life.

A further object is to provide such a tool which can be employed without specialized control equipment.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figures 1, 2, 3, 4, 5:
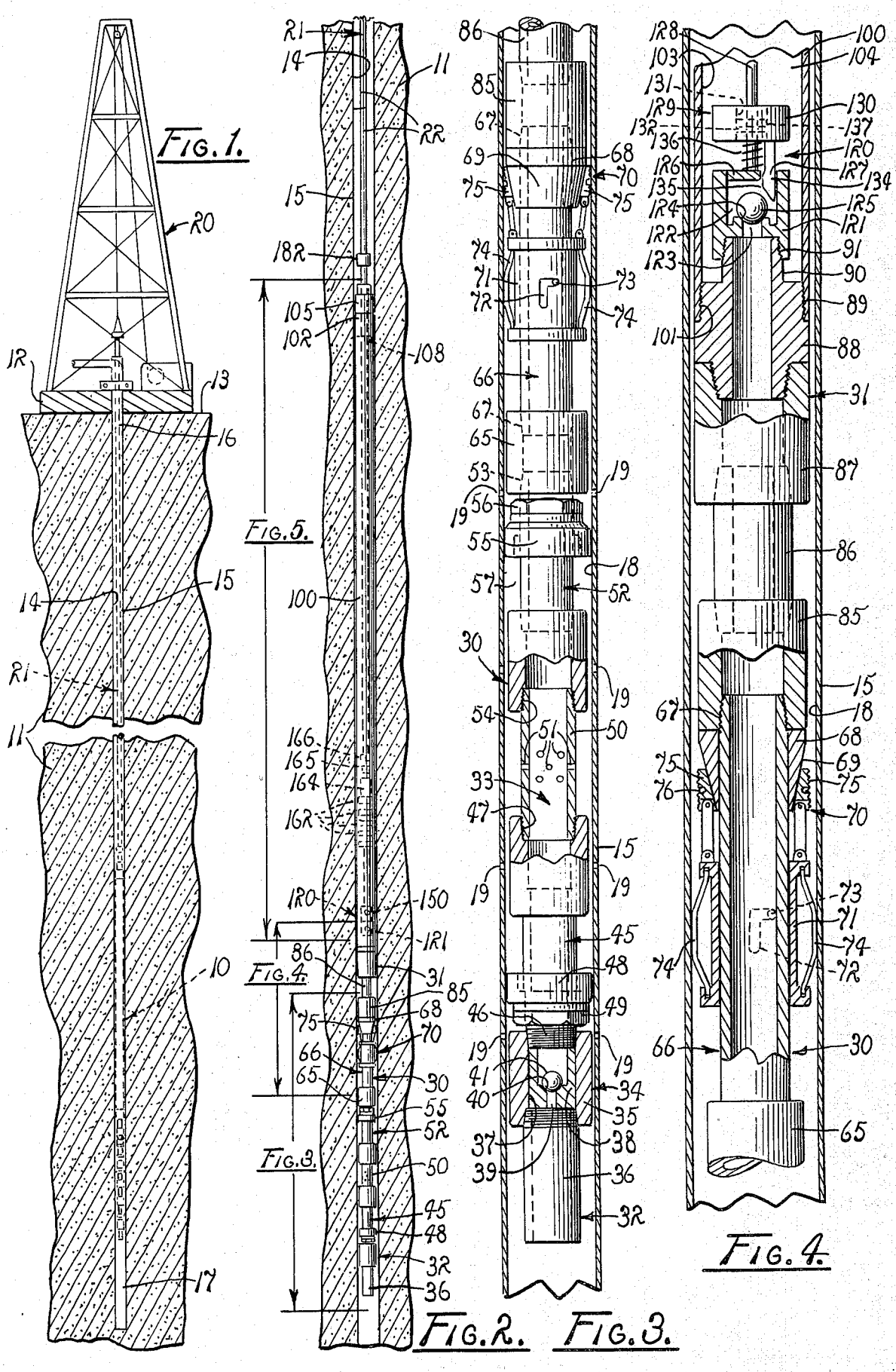
FIG. 1 is a fragmentary vertical section of a typical well construction showing the tool received in the well casing thereof in position for use.
FIG. 2 is a somewhat enlarged fragmentary vertical section of a portion of the well viewed in FIG. 1 showing the tool of the present invention in position therein.
FIG. 3 is a somewhat further enlarged fragmentary vertical section of the casing and portion of the tool indicated in FIG. 2.
FIG. 4 is a still further enlarged fragmentary vertical section of the casing and portion of the tool indicated in FIG. 2.
FIG. 5 is a fragmentary vertical section of the casing and portion of the tool indicated in FIG. 2.
Figure 5:
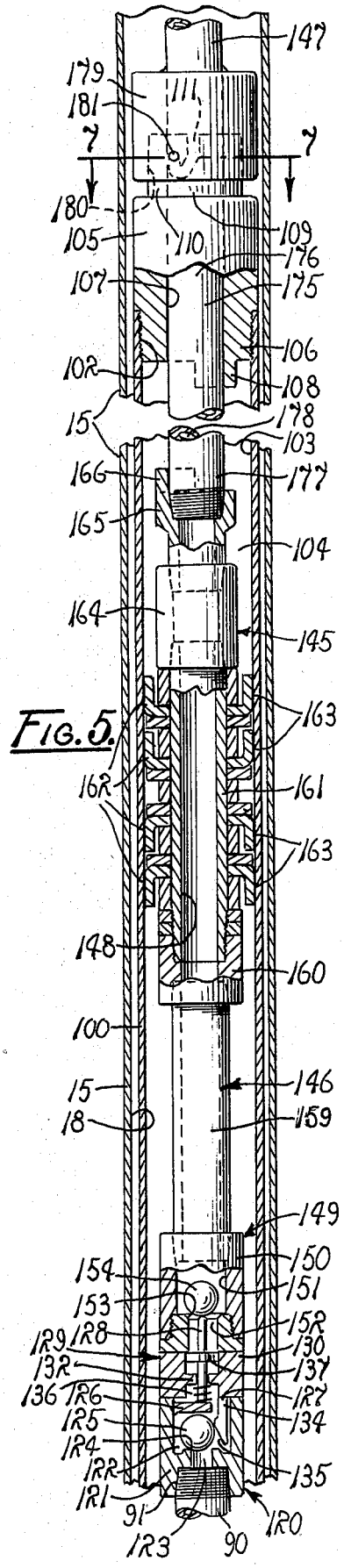

Referring more particularly to the drawing, the tool of the present invention is generally indicated by numeral 10. The tool is shown in FIG. 1 in a representative operative environment wherein the earth is indicated at 11. A formation 12 bearing the substance, such as oil, to be recovered is located at depth in the earth below the earth's surface 13. A borehole or well 14 is formed in the earth extending into the formation. A substantially cylindrical well casing 15, having an upper end portion 16 and a lower end portion 17, is mounted in the conventional manner within the borehole. The casing has a substantially cylindrical internal surface 18 and has a plurality of perforations 19 extending therethrough at a depth corresponding to that of the formation 12. A conventional well rig 20 is mounted on the earth's surface 13. The rig is operable to manipulate a pipe string 21 composed of a multiplicity of endwardly interconnected pipe sections 22 in the conventional manner as required for the proper operation and servicing of the well. The tool 10 of the present invention is adapted to be suspended in depending relation on the pipe string 21, as will hereinafter be described. The tool can be of any desired length and is preferably of the elongated constructions best shown in FIG. 2. The tool has a lower or first conduit assembly 30 best shown in FIGS. 3 and 4. The first conduit assembly has an upper end portion 31 and an opposite lower end portion 32. The first conduit assembly has an internal passage 33 extending substantially axially therethrough and communicating with the exterior thereof through the opposite upper and lower end portions. With specific attention to FIG. 3 showing the lowermost portion of the first conduit assembly, the lower end portion 32 has a check valve assembly 34. The check valve assembly is composed of a screwthreadably interconnected union 35 and fitting 36 disposed in substantially axial alignment about the internal passage 33 of the first conduit assembly and enclosing an internal chamber 37. A valve cage 38 is received within the chamber of the valve assembly and has a port 39 circumscribed by a valve seat 40 interconnecting the interior of the cage and the interior of the fitting. A ball 41 is received within the cage and adapted removably to seat in fluid sealing relation in the valve seat, as best shown in FIG. 3, thereby obstructing the internal passage 33 of the first conduit assembly at that point.

A first fitting 45, having a male end portion 46 and a female end portion 47, is mounted in axial alignment with the check valve assembly 34 by screw-threaded connection of the male end portion 46 to the union 35. An annular resilient cup or seal 48 is received about the male end portion of the first fitting and held in place by a lock nut 49. The annular seal should be of a diameter corresponding approximately to the internal diameter of th well casing 15. If the tool 10 is to be employed in a well which does not have a casing then, of course, the diameter of the seal should correspond to the internal diameter of the borehole 14 within which the tool is to be used. The cup or seal should be disposed on the fitting to face in a direction away from the check valve assembly 34, as shown in FIG. 3.

A fluid transmission conduit 50 is screw-threadably received in the female end portion 47 of the fitting 45 in substantially axial alignment with the check valve assembly 34. The conduit 50 has a plurality of passages or ports 51 extending interconnecting the internal passage 33 of the first conduit assembly 30 and the exterior of the tool 10. A second fitting 52 which has a structure substantially identical to the first fitting 45 and which has a male end portion 53 and a female end portion 54 is mounted on the transmission conduit 50 in substantially axial alignment therewith by screw-threaded engagement of the female end portion 54 thereof about the conduit 50, as best shown in FIG. 3. An annular resilient cup or seal 55, substantially identical to seal 48 is received on the male end portion 53 of the second fitting and held in place by a lock nut 56. As shown in FIG. 3, the seals 48 and 55 should face toward each other and when received in the well casing 15 define with the internal surface 18 of the casing an annular chamber 57.

A union 65 is screw-threadably mounted on the male end portion 53 of the second fitting 52. A conduit 66, having opposite male end portions 67, is screw-threadably mounted on the union 65 by a male end portion 67 so as to extend in axial alignment with and form a part of the first conduit assembly 30. A cam member 68 is secured on the conduit 66 adjacent to the male end portion 67 remote from the union 65. The cam member has a cam way 69 sloping outwardly from the conduit concentric thereto and in a direction away from the check valve assembly 34.

A gripping mechanism or locking assembly 70 is mounted on the conduit 66, as best shown in FIGS. 3 and 4. The locking assembly has a sleeve 71 which is received for longitudinal slidable movement on the conduit between the union 65 and the cam member 68. The sleeve has a right angle slot 72 in a predetermined position therein and of predetermined dimensions through which is extended a pin or slot follower 73 borne by the conduit. Thus, movement of the sleeve about the conduit 66 is limited by engagement of the pin in the slot.

A plurality of resilient, motion resistant elements 74 are mounted on and extended outwardly from the sleeve 71 for engagement with the internal surface 18 of the well casing 15. The elements provide sufficient resistance to movement when in engagement with the internal surface of the well casing to retain the sleeve in a fixed position so as to allow movement of the conduit 66 with respect thereto within the limits defined by the slot 72 and follower 73 for purposes subsequently to be explained. A plurality of gripping members 75 are pivotally mounted on the sleeve and extend into engagement with the cam way 69 of the cam member 68 as best shown in FIG. 4. The members are retained in engagement with the cam way by a resilient ring 76 extending about the members so as to retain them in engagement with the cam way. The relationship of the locking assembly to the cam member is such that relative movement of the conduit 66 through the sleeve 71 as limited by the slot and pin motivates the gripping members between a retracted position shown in FIG. 3 and 4 and an extended position in which the gripping members securely but releasibly, as will be described, engage the internal surface 18 of the well casing 15.

A union 85 is mounted on the male end portion 67 of the conduit 66 remote from the union 65. A fitting 86 is screw-threadably secured on the union 85. A union 87 is screw-threadably mounted on the fitting 86, as best shown in FIG. 4. A housing mount 88 is screw-threadably secured on the union 87. The housing mount has outer screw threads 89 and a central nipple 90 having central screw-threads 91 extended thereabout substantially concentric to the outer screw-threads 89.

Figure 6:
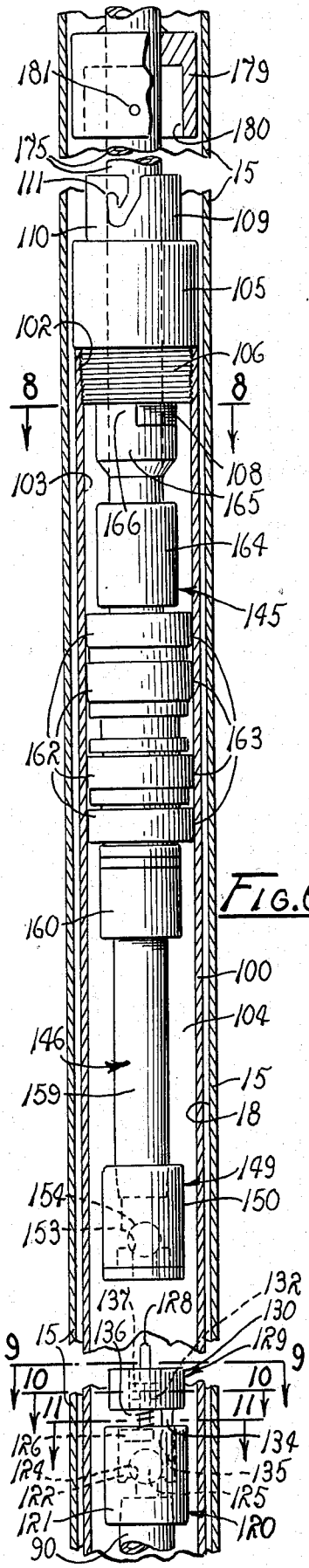
FIG. 6 is a fragmentary vertical section of the casing and portion of the tool viewed in FIG. 5 disposed in a second operative configuration.
Figure 7:
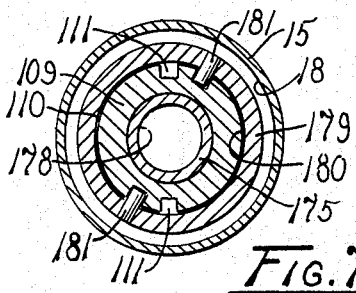
FIG. 7 is a transverse section taken from a position indicated by line 7—7 in FIG. 5.
Figure 8:
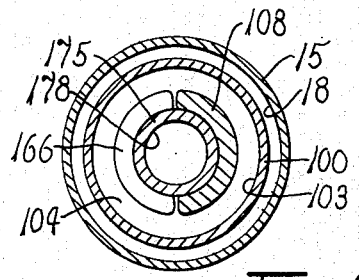
FIG. 8 is a transverse section taken from a position indicated by line 8—8 in FIG. 6.
Figure 9:
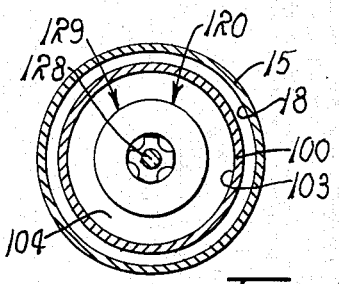
FIG. 9 is a transverse section taken from a position indicated by line 9—9 in FIG. 6.
Figure 10:
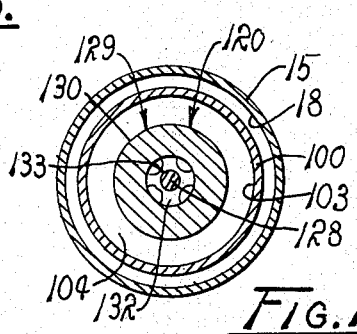
FIG. 10 is a transverse section taken from a position indicated by line 10—10 in FIG. 6.
Figure 11:
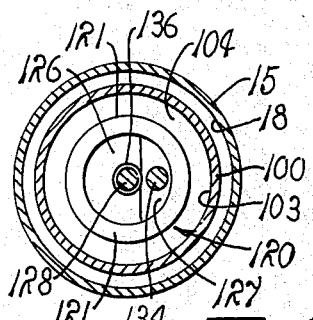
FIG. 11 is a transverse section taken from a position indicated by line 11—11 in FIG. 6.

An elongated pump housing 100, having an internally screw-threaded end portion 101 and an opposite internally screw-threaded portion 102, is screw-thredably secured by end portion 101 on the outer screw-threads 89 of the housing mount 88 in substantial axial alignment with the first conduit assembly 30, as best shown in FIGS. 4 and 5. The housing is substantially cylindrical and has an internal surface 103. For purposes that will subsequently become more clearly apparent and as perhaps can best be seen in FIG. 2, the housing is preferably of considerable length, as for example, in the range of from 15 to 20 feet. The housing encloses an internal pump chamber 104. The housing has an end fitting 105, having a mounting end 106, which is screw-threadably secured on the internal screw-threaded portion 102 of the housing by its mounting end. The fitting has an axial bore 107. A clutch member 108 is affixed on and extended from the mounting end of the end fitting into the pump chamber concentric to the axis defined by the axial bore as best shown in FIGS. 5, 6 and 8. The fitting, remote from the mounting end 106, has an integral fastening or upper end portion 109 of predetermined smaller diameter than that of the end fitting. The end portion 109 has a smooth cylindrical surface 110. The surface 110 has a return-bent slot 111 therein as best shown in FIGS. 5 and 6.

A valve mechanism 120 is fastened on the central screw threads 91 of the nipple 90 within the pump chamber 104 of the pump housing 100, as best shown in FIG. 4. The valve mechanism has a check valve or ball housing 121 which is screw-threadably secured on the screw threads of the nipple. The ball housing encloses a chamber 122. An axial port 123 extends through the housing so as to communicate with and form a portion of the internal passage 33 of the first conduit assembly 30. An annular ball seat 124 circumscribes the port within the chamber and is adapted to receive in fluid sealing relation a ball 125 thus releasibly sealing the internal passage 33 at that point.

A supporting wall 126 is mounted on the ball housing 121 extending over the chamber 122 so as to define a fluid passage 127. A control member or prong 128 is affixed on the supporting wall 126 in substantial axial alignment with the first conduit assembly 30 extending toward the end fitting 105 of the pump housing 100.

A control member 129 is slidably received on the prong 128 as best shown in FIG. 4. The control member 129 has a body 130 with a central passage 131. A perforated guide structure 132 is mounted within the passage of the body so as to permit the passage of fluid therethrough. The guide structure has a central bore 133 through which the prong 128 is extended to mount the body 130 thereon for movement to and from the ball housing 121. A prong 134, having a flared end 135, is fastened on the body 130 extending through the fluid passage 127 of the ball housing 121 so that the flared end is received within the chamber 122 thereof. A compression spring 136 is extended about the prong 128 and engages the supporting wall 126 and the guide structure 132 of the control member 129 so as to urge the control member from the ball housing. A perforated stop 137 is secured on the prong 128 in a predetermined position to limit endward movement of the control member 129 on the prong by engagement with the guide structure 132. It will be seen that movement of the control member 129 against the compression spring 136 toward the ball housing causes the flared end of prong 134 to engage and displace the ball 125 from the ball seat 124 thereby establishing fluid communication between the pump chamber 104 of the pump housing 100 and the internal passage 33 of the first conduit assembly 30.

An upper or second conduit assembly 145, having a lower end portion 146 and an upper end portion 147 is mounted on the pump housing 100 in axial alignment with the housing and the first conduit assembly 30. The lower end portion 46 of the second conduit assembly is extended through the axial bore 107 of the end fitting 105 of the housing and received for reciprocal movement within the pump chamber 104 of the housing, as best shown in FIGS. 5 and 6. The second conduit assembly has an internal passage 148 extended therethrough.

A check valve 149 is mounted on the remote downwardly extending end of the lower end portion 146 of the second conduit assembly 145. The check valve is composed of a housing 150 enclosing a chamber 151. The chamber communicates with the exterior of the housing through a port 152 disposed in axial alignment with the internal passage 148 of the second conduit assembly. A ball seat 153 circumscribes the port within the chamber and is adapted to receive a ball 154 in fluid sealing relation therein. As can be seen in FIG. 5, when the check valve 149 engages the control member 129 of the valve mechanism 120 of the first conduit assembly 30, the control member 129 is urged against the compression spring 136 to cause the flared end 135 of the prong 134 to displace the ball 125 from the ball seat 124. Simultaneously, the prong 128 displaces the ball 154 of check valve 149 from the ball seat 153 to establish fluid communication through the interconnected check valve. Thus, the internal passage 148 of the second conduit assembly with the internal passage 33 of the first conduit assembly 30 are interconnected for fluid transfer in either direction therethrough. At all other times, however, the check valves operate to permit fluid passage only from the internal passage 33 of the first conduit assembly into the pump chamber 104 of the housing 100 and then, upon downward movement of the second conduit assembly, into the internal passage 148 thereof.

A conduit 159 is mounted on the housing 150 of check valve 149 in axial alignment therewith composing a portion of the lower end portion 146 of the second conduit assembly. The conduit mounts a union 160 in spaced relation to the check valve 149, as best shown in FIG. 5. A pipe fitting 161 is screw-threadably secured in the union 160 in axial alignment with the conduit 159. The fitting mounts a pump seal assembly 162 thereabout, as best shown in FIGS. 5 and 6. The assembly has peripheral surfaces 163 which resiliently engage the internal surface 103 of the pump housing 100. A union 164 is secured on the remote end of the fitting 161 so as to capture the pump seal assembly on fitting 161 between the unions 160 and 164. A clutch fitting 165 is screw-threadably fastened on the union 164 and mounts a clutch member 166 extending therefrom in a direction away from the pump seal assembly and concentric to the internal passage 148 of the second conduit assembly for selective engagement with the clutch member 108 of the pump housing 100, as shown in FIGS. 6 and 8.

An elongated pump rod or conduit 175, having an upper end portion 176 and a lower end portion 177, is mounted on the clutch fitting 165 by its lower end portion 177 extending in axial alignment with the conduit 159 and fitting 161 and composing a portion of the second conduit assembly 145. The lower end portion of the pump rod is slidably received in the axial bore 107 of the end fitting 105 with the lower end portion 146 of the second conduit assembly 145 thus received for slideable movement within the pump chamber 104, as shown in FIGS. 5 and 6. The pump rod has an internal passage 178 extending the full length thereof and composing a part of the internal passage 148 of the second conduit assembly. A fastening member 179 is secured, as by welding, on the upper end portion of the pump rod and has an internal, substantially cylindrical receptacle 180 facing in the direction of the pump housing 100 and adapted to receive the upper end portion 109 of the housing therewithin. The fastening member mounts a pin or follower 181 extending into the receptacle thereof in a predetermined position and adapted selectively to be received in the return-bent slot 111 of the upper end portion of the housing, as best shown in FIG. 5, when the check valves 121 and 149 are engaged as previously described. The remote upper end portion 176 of the pump rod mounts a connection coupling 182 adapted to be screw-threadably connected to the pipe string 21 in fluid transferring relation to permit insertion of the tool 10 to any desired position in a borehole or well 14.

Thus, the internal passage 148 extends the entire length of the second conduit assembly 145, communicating by one end thereof with well rig 20 through the pipe string and at the other end thereof with the pump chamber 104 as controlled by check valve 149, as previously described. Similarly, the internal passage 33 of the first conduit assembly 30 extends the entire length thereof communicating with the pump chamber 104 as controlled by check valve 121 and at the other end thereof with the exterior of the tool through ports 51 and as controlled by check valve 34.

OPERATION

The operation of the described embodiment of the subject invention is believed to be clearly apparent and is briefly summarized at this point. As previously discussed, the tool 10 is adapted to be connected to the lower end of a pipe string 21 composed of a multiplicity of endwardly interconnected pipe sections 22 interconnected in sufficient numbers, as directed by conventional practice and as shown in FIG. 1, to position the tool within the well casing 15 at the desired depth. Normally, the desired depth will be the depth at which the perforations 19 extend through the well casing and communicate with the formation 12 within the earth 11 beyond the casing. However, servicing can be performed utilizing the tool at any desired point in the well.

The tool need not be adjusted in any particular configuration prior to insertion in the well casing 15. However, it is most convenient to adjust the tool to the configuration shown in FIG. 5 prior to insertion in the well casing since this is normally the first operable configuration of the tool in order to inject fluids such as acid into the formation. In this configuration, the pump rod 175 is motivated toward the first conduit assembly 30 until the check valve 149 thereof engages the valve mechanism 120 of the first conduit assembly within the pump housing 100. As previously discussed, this causes the valve mechanism to operate to displace the balls 125 and 154 from their respective ball seats 124 and 153. The tool is retained in this configuration by engagement of the fastening member 179 of the pump rod 175 with the upper end portion 109 of the pump housing as shown in FIG. 5. The fastening member is positioned so that the follower 181 thereof is received within the return-bent slot 111 of the upper end portion 109 and motivated into the locked position shown in FIG. 5 at the end of the slot.

The tool 10 is connected to the pipe string 21 by the connection coupling 182 of the pump rod which screw-threadably engages the end of the pipe section composing the lowermost portion of the pipe string. The pipe string is thus simply assembled in the conventional manner to position the tool at the desired depth, that is normally at the level of the perforations 19 within the well casing 15. When the tool is adjusted to the described configuraton and the tool is lowered on the pipe string to the desired position, fluid communication is established from the earth's surface extending through the pipe string 21, the second conduit assembly 145, the first conduit assembly 30 and outwardly of the tool through the ports 51 in the fluid transmission conduit 50.

As can best be seen in FIG. 3, the annular seals 48 and 55 are slidable within the well casing 15 against the internal surface 18 therof. When the tool has been positioned at the desired depth, as shown in FIG. 3, the seals 48 and 55 engage the internal surface of the casing to define the annular chamber 57 thereby establishing fluid communication between the ports 51 of the tool and the perforations 19 of the well casing. Subsequently, the desired fluid, such as hydrochloric or hydrofluoric acid or a suitable cleansing agent is pumped down the pipe string or simply allowed to flow gravitationally down the pipe string through the first and second conduit assemblies 30 and 145, through the ports 51 and into the annular chamber 57. The tremendous weight of the fluid standing within the pipe string subsequently forces the fluid to fill the annular chamber. Since the seals or cups face each other as described, the creation of fluid pressure within the annular chamber 57 forces the seals outwardly to establish positive fluid-tight engagement of the seals with the casing. Thus, the weight of the fluid standing in the pipe string causes the fluid to be expelled from the casing through the perforations 19 and into the formation 12. The fluid is thus forced into the remote portions of the formation laterally of the well casing so that the fluid, that is the acid, cleansing agent or the like can operate to treat the formation in the desired manner.

A suitable period of time is then allowed to permit the fluid to perform its task. With fluids such as hydrochloric and hydrofluoric acid, this period of time commonly may vary from 1 to 24 hours. Obviously, however, any desired length of time can be allowed to permit the fluid to accomplish its intended purpose. During this period of time, the tool can be left in the position reached during injection of the fluid into the formation or pulled a suitable distance upwardly in the well casing 15 above the perforations so as to avoid permitting the tool to remain in contact with fluids which are corrosive for an inordinate period of time.

Utilizing a well rig 20, the pipe string 21 is then again lowered to position the annular 57 defined by the annular seals 48 and 55 of the tool 10 in communication with the perforations 19 of the well casing 15. With the fastening member 179 still locked in engagement with the upper end portion 109 of the pump 100, as shown in FIG. 5 and heretofore described, the pipe string 21 and thus the tool is rotated using the well rig 20 in a clockwise direction as viewed in FIGS. 7 through 11. Such rotation is transmitted to the first conduit assembly 30 by way of the first and second conduit assemblies and housing 100 being united, as previously described. Thus, the conduit 66 is rotated in the same direction within the locking assembly 70. The motion resistant elements 74 engaging the well casing 15 operate to prevent the sleeve 71 of the locking assembly from being similarly rotated. Therefore, the follower or pin 73 is freed from the right angle portion of the slot 72 thereby permitting, for the first time, movement of the conduit 66 within the sleeve along a vertical axis. Operating as previously described, the first conduit assembly 30 is then lowered relative to the sleeve of the locking assembly which is retained in position by the resistant elements 74 of the sleeve 71. This causes the gripping members 75 to be forced outwardly against the internal surface 18 of the well casing 15 so as releasibly to bind the first conduit assembly 30 in the selected position in the well casing. Thus, the first conduit assembly is retained in position with the annular chamber 57 in communication with the perforations 19 of the well casing.

Subsequently, the pipe string 21 is again maneuvered, utilizing the well rig 20, to cause the follower 181 of the fastening member 179 to be released from the return-bent slot 111 of the upper end portion 109 of the housing 100 thereby freeing the second conduit assembly 145 for reciprocal movement of the lower end portion 145 thereof within the pump chamber 104 of the pump housing 100. The check valve 149 of the second conduit assembly is thus freed from engagement with the valve mechanism 120 as shown in FIG. 6. The balls 125 and 154 consequently are freed to seat in their respective ball seats 124 and 153 respectively.

Using the well rig 20, the pipe string 21 and thus the second conduit assembly 145 connected thereto are reciprocated so as to cause the pump seal assembly 162 to move upwardly and downwardly within the pump chamber 104 of the pump housing 100 to create a vacuumatic attraction. The upward stroke draws the fluid which has been injected into the formation 12 from the formation, through the perforations 19, the ports 51, up the internal passage 33 of the first conduit assembly, through the valve mechanism 120 and into the pump chamber of the pump housing. The upward stroke similarly draws some of the fluid which may have drained from the perforations downwardly in the casing beneath the tool as well as, for example, sand which may have been emulsified by acid, into the first conduit assembly 30 through check valve assembly 34. The downward stroke of the second conduit assembly creates fluid pressure within the pump chamber which causes the ball of the valve mechanism 120 to seat in its respective ball seat so as to prevent fluid movement from the pump chamber back into the first conduit assembly. However, same fluid pressure causes the ball of the check valve 149 to be freed from its ball seat 153 during the down stroke to admit fluid being compressed within the pump chamber between the pump seal assembly and the lower end of the housing into the second conduit assembly and upwardly through the internal passage 148 of the second conduit assembly. Continuance of this pumping operation, of course, causes the fluid to be pumped upwardly through the pipe string 21 to the earth's surface 13. This extraction of the injected fluid is continued until clean oil or water, depending upon the particular well involved, is received at the earth's surface thereby signaling the extraction of all of the available formation treating fluid from the formation.

This described cycle of injecting and subsequently extracting fluid from the formation can be repeated with the same type of fluid if the results are not satisfactory. Similarly, a suitable cleansing agent, water of any other fluid can be injected and extracted by repeating the processes described. It is unnecessary to remove the tool 10 from the well 14 between such repeated applications of fluid before well operation is restarted. When it is desired to remove the tool 10 from the well casing 15, the pipe string 21 is drawn up the well casing by the well rig 20 until the clutch member 166 of the second conduit assembly 145 engages the clutch member 108 of the housing 100, as shown in FIG. 6. Movement is continued so as to transmit such movement to the conduit 66 of the first conduit assembly 30 thereby drawing the cam member 68 in a direction away from the sleeve 71 of the locking assembly 70. With the cam member removed, the resilient ring 76 returns the gripping members 75 to the retracted position shown in FIGS. 3 and 4 out of engagement with the internal surface 18 of the well casing 15. In order to retain the locking assembly 70 in this retracted configuration, the pipe string is rotated, utilizing the engaged clutch members 108 and 166 in a counterclockwise direction as viewed in FIGS. 7 through 11, to transmit such movement to the conduit 66 of the first conduit assembly 30. Therefore, the pin 73 is drawn laterally to the locked position in the right angle slot 72 shown in FIGS. 3 and 4. This retains the locking assembly in the retracted configuration. The tool 10 is then simply withdrawn from the well casing 15 utilizing the well rig 20 and pipe string 21 in the conventional fashion.

It will be seen that a tool 10 of given diameter can be adjusted for use in wells of other diameters simply by replacing the seals 48 and 55 and perhaps the motion resistant elements 74 and gripping members 75 with replacement parts of the appropriate size. This is accomplished simply and efficiently by ready disassembly of those portions of the tool retaining these structures in position.

Therefore, the tool of the present invention permits the servicing of a wide variety of types of wells by the application of fluids such as acids, solvents, cleansing agents and the like to any portion thereof as well as to formation beyond the well and the subsequent extraction of such fluids from the well in sequence without requiring removal of the tool from the well until it is ready again to be placed in operation.

Although the invention has been herein shown and described in what is conceived to be the most practical and preferred embodiment, it is recognized that departures may be made therefrom within the scope of the invention, which is not to be limited to the illustrative details disclosed.

Having described our invention, what we claim as new and desire to secure by Letters Patent is:

1. A well servicing tool comprising a first assembly having an internal passage communicating with the exterior of the assembly through a fluid port; a housing borne by the first assembly in endwardly disposed fluid-tight relation; a second assembly, having an internal passage, mounted on the housing remote from the first assembly and having an end portion received within said housing for reciprocal movement toward and from the first assembly; means borne by said first assembly for selectively gripping the interior surface of a well to permit said predetermined movement of the end portion of the second assembly; pump means borne by said end portion of the second assembly within the housing for pumping fluid into the internal passage of the first assembly through the fluid port upon said reciprocal movement; and valve means borne by the end portion of the second assembly and the first assembly for selectively establishing fluid communication between the internal passages of the second assembly and the first assembly in the direction of said fluid port upon predetermined movement of the end portion of the second assembly toward said first assembly.

2. The tool of claim 1 wherein said gripping means includes a gripping mechanism operable releasibly to bind itself to said interior surface of the well upon predetermined movement of the first assembly relative to the mechanism; and a pair of clutch members individually mounted on the end portion of the second assembly and the housing and engageable upon predetermined positioning of the second assembly to transmit said predetermined movement to the first assembly by corresponding movement of the second assembly.

3. The tool of claim 1 wherein the first assembly mounts a pair of seals thereabout on opposite sides of the fluid port for fluid sealing engagement with the interior surface of the well whereby said fluid movement through the port is to and alternatively from the area bounded by said seals.

4. The tool of claim 1 wherein the second assembly mounts a coupling opposite said end portion received in the housing adapted for connection to a conduit assembly whereby said tool can be inserted to selected positions in a well.

5. The tool of claim 4 including a mechanism borne by the second assembly for releasible engagement with the housing to secure said valve means of the end portion of the second assembly and the first assembly in interconnecting, fluid communicating relation to permit fluid to be transmitted to a predetermined point in a well from the earth's surface by passage through the conduit assembly, the second assembly, the fluid passage of the first assembly and from the tool through said fluid port at the predetermined point in the well.

6. A well servicing tool comprising a first assembly having an internal fluid passage communicating with the exterior of the assembly through a fluid port; a housing borne by the first assembly in endwardly disposed fluid-tight relation; a second assembly mounted on the housing remote from the first assembly and having an end portion received within said housing for reciprocal movement toward and from the first assembly and a coupling opposite said end portion adapted for connection to a conduit assembly whereby said tool can be inserted to selected positions in a well; means borne by said first assembly for selectively gripping the interior surface of a well to permit movement of the end portion of the second assembly toward and from the first assembly in the housing and said gripping means includes a gripping mechanism operable releasibly to bind itself to said interior surface of the well upon predetermined movement of the first assembly relative to the mechanism, and a pair of clutch members individually mounted on the end portion of the second assembly and the housing and engageable upon predetermined positioning of the second assembly to transmit said predetermined movement to the first assembly by corresponding movement of the second assembly; pump means borne by said end portion of the second assembly within the housing for pumping fluid into the first assembly through the fluid port upon said reciprocal movement; valve means borne by the end portion of the second assembly and the first assembly for selectively establishing fluid communication between the second assembly and the fluid passage of the first assembly upon predetermined movement of the end portion of the second assembly toward said first assembly; and a mechanism borne by the second assembly for releasible engagement with the housing to secure said valve means of the end portion of the second assembly and the first assembly in interconnecting, fluid communicating relation to permit fluid to be transmitted to a predetermined point in a well from the earth's surface by passage through the conduit assembly, the second assembly, the fluid passage of the first assembly and from the tool through said fluid port at the predetermined point in the well.

7. The tool of claim 6 wherein the first assembly mounts a pair of seals thereabout on opposite sides of the fluid port for fluid sealing engagement with the interior surface of the well whereby said fluid movement through the port is to and alternatively from the area bounded by said seals.

8. The tool of claim 7 wherein the gripping means includes a sleeve received for slidable movement on the first assembly and having interior surface engaging members limitedly resistant to movement relative to said surface, the first assembly mounts a cam member, a pair of gripping members are borne by said sleeve in slidable engagement with the cam member and the sleeve and first assembly are interconnected by a slot and follower whereupon said gripping members are releasibly retained in a position retracted from interior surface engagement by the follower and slot and said gripping members are guided by the cam member into releasible binding engagement with the interior surface upon said predetermined movement of the first assembly as guided by the follower in the slot.

9. The tool of claim 8 wherein the valve means includes a first check valve mounted on the end portion of the second assembly having a ball and seat normally operable to allow fluid movement only into the second assembly through said check valve and the first assembly mounts a second check valve thereon within the housing and in communication with the fluid passage of the first assembly and having a ball and seat normally operable to allow fluid movement through the second check valve only from said fluid passage and said second check valve includes a valve mechanism operable by said movement of the end portion of the second assembly and thus the first check valve to the first assembly to displace the balls of the first and second check valve from their respective seats to permit fluid movement between the first and second assemblies in two directions through the check valves.

10. The tool of claim 9 wherein a third check valve is mounted on the first assembly remote from the housing and having a normally engaged ball and seat permitting fluid movement only into the first assembly through the third check valve for purposes of clearing the well beneath the tool during said pumping.

11. A tool for use in a well casing perforated at a remote subsurface location so as to communicate with a formation laterally of said location, to inject a formation treating agent through the perforations into the formation beyond the casing and subsequently to remove the agent so as to improve well productivity, the tool comprising:

A. a first conduit assembly having predetermined upper and lower end portions, a longitudinal fluid passsage and a plurality of fluid ports extending therethrough in communication with the passage intermediate said upper and lower end portions;

B. seals for well casing engagement mounted on and extending about the first conduit assembly individually disposed between said fluid ports and the upper end portion and between said fluid ports and the lower end portion respectively;

C. a cam member borne by the first conduit assembly intermediate the upper and lower end portions;

D. a releasible locking assembly mounted on the first conduit assembly for movement to and from the cam member, having movement resistant elements borne thereby for frictional contact with the well casing, locking members extending therefrom in guided engagement with the cam member whereupon relative movement of the locking assembly and cam member toward each other forces said locking members into position for locking engagement with the well casing and an engaged slot and slot follower interconnecting the first conduit assembly and locking assembly limiting relative movement of the locking assembly and first conduit assembly between a position in which said locking members are retracted from casing engagement and a position in which said locking members are extended for casing engagement;

E. a valve mechanism mounted on the upper end portion of the first conduit assembly in communication with the fluid passage thereof adapted normally to permit fluid movement only in a direction from said passage out the upper end portion of the first conduit assembly, having a first control member mounted for movement thereon in the direction of the lower end portion of the first conduit assembly operating the mechanism to permit fluid movement into the fluid passage at the upper end portion of the first conduit assembly and having a second control member endwardly extended from said upper end portion;

F. an elongated tubular housing secured in fluid-tight relation on the upper end portion of the conduit assembly about the valve mechanism enclosing a pump chamber and having a sealed upper end portion;

G. a second conduit assembly having a predetermined upper end portion adapted for endward conection to a pipe string, for suspension of the tool therefrom in a well casing at a remote subsurface location, and a predetermined lower end portion mounted on the housing and received for reciprocal movement within and longitudinally of the pump chamber;

H. pump seals mounted on the lower end portion of the second conduit assembly within said pump chamber in engagement with the housing;

I. a check valve mounted on the lower end portion of the second conduit assembly normally permitting fluid movement only into said lower end portion of the second conduit assembly; and J. a fastening member secured on the second conduit assembly externally of the housing and adapted for releasible connection to the upper end portion of said housing whereby said check valve of the second conduit assembly engages the first and second control members of the valve mechanism to open both the check valve and the valve mechanism to permit the movement of the formation treating agent therethrough from the second conduit assembly into the passage of first conduit assembly for transmission through the fluid ports, the perforations in the casing and into the formation and to permit predetermined motion applied to said pipe string to be transmitted through the housing to the first conduit assembly to move said slot and slot follower of the locking assembly relative to each other to extend said locking members thereof for casing engagement thereby, upon release of said fastening member from the housing, to permit reciprocation of the lower end portion of the second conduit assembly by corresponding movement of the pipe string to pump said formation treating agent from the formation, through the perforations of the casing, through the fluid ports into the passage of the first conduit assembly, through the valve mechanism and check valve and into the second conduit assembly thereafter permitting the second conduit assembly to be raised to cause the locking assembly to be operated to retract said locking members for removal of the tool from the casing.

12. The tool of claim 11 wherein the slot of the locking assembly has a right angle portion in which the slot follower can be received to retain the locking assembly in the retracted configuration, a first clutch member is affixed on the upper end portion of the housing within the pump chamber and a second clutch member is borne by the second conduit assembly within the pump chamber between the pump seals and the upper end portion of the housing and engageable with the first clutch member upon raising of the second conduit assembly to permit the application of rotational movement to the first conduit assembly upon corresponding application to the pipe string to position said slot follower in said right angle portion of the slot of the locking assembly.

13. A tool for use in a well having an internal surface, the tool comprising a first assembly having an internal passage communicating with the exterior of the assembly through a substantially laterally facing fluid port; a housing borne by the first assembly; means affixed on the first assembly for sealing engagement with the internal surface of the well to form a fluid conductive passage interconnecting the fluid port and a portion of the internal surface bounded by said engagement of the sealing means; a second assembly borne by the housing and having an end portion received for reciprocal movement within the housing to pump fluid in a first direction through the fluid conductive passage and into the internal passage of the first assembly through said fluid port; and means mounted on the first assembly and the end portion of the second assembly for engagement upon predetermined movement of said end portion toward the first assembly to establish fluid communication through said first and second assemblies in a second direction to said fluid port.

14. The tool of claim 13 including means borne by the first assembly for selectively gripping the internal surface of the well to retain the first assembly in fixed position to permit said reciprocal movement of the second assembly relative thereto.

15. The tool of claim 14 wherein the gripping means are operable upon predetermined movement of the first assembly; and means are borne by the housing and the second assembly for engagement selectively to transmit said predetermined movement to the first assembly by corresponding movement of the second assembly after engagement of said engagement means.

* * * * *

UNITED STATES PATENT AND TRADEMARK OFFICE

CERTIFICATE OF CORRECTION

PATENT NO. : 3,990,509

DATED : November 9, 1976

INVENTOR(S) : Floyd R. Hedgecock; Charles L. Van Atta

It is certified that error appears in the above-identified patent and that said Letters Patent are hereby corrected as shown below:

Column 3, Line 38, the sentence beginning "The tool 10" should be new paragraph.

Column 5, Line 6, delete "Fig." and insert ---Figs.---.

Column 5, Line 22, delete "screw-thredably" and insert ---screw-threadably---.

Column 6, Line 53, delete "valve" and insert ---valves---.

Column 7, Line 48, after "with" and before "well" insert ---the---.

Column 8, Line 44, delete "therof" and insert ---thereof---.

Column 9, Line 14, after "annular" and before "57" insert ---chamber---.

Column 9, Line 18, after "pump" and before "100" insert ---housing---.

Column 10, Line 68, delete "formation" and insert ---formations---.

Column 13, Line 7, delete "valve" and insert ---valves---.

Signed and Sealed this

First Day of March 1977

[SEAL]

*Attest:*

RUTH C. MASON
*Attesting Officer*

C. MARSHALL DANN
*Commissioner of Patents and Trademarks*